US005363182A

United States Patent [19]

Kuribayashi et al.

[11] Patent Number: 5,363,182

[45] Date of Patent: Nov. 8, 1994

[54] BLADE DEVICE AND IMAGE FORMING APPARATUS

[75] Inventors: Ikuo Kuribayashi, Tokyo; Rie Saito, Yokohama, both of Japan

[73] Assignee: Canon Kabushiki Kaisha, Tokyo, Japan

[21] Appl. No.: 59,852

[22] Filed: May 11, 1993

[30] Foreign Application Priority Data

May 21, 1992 [JP] Japan ..... 4-153087

[51] Int. Cl.[5] ..... G03G 21/00

[52] U.S. Cl. ..... 355/299; 118/652; 15/256.5; 15/256.51; 355/296

[58] Field of Search ..... 355/296, 299, 301; 118/652; 15/250.36, 245, 250.42, 256.51, 256.5; 430/125

[56] References Cited

U.S. PATENT DOCUMENTS

| | | | |
|---|---|---|---|
| 3,936,183 | 2/1976 | Sadamatsu | 355/299 |
| 4,825,249 | 4/1989 | Oki et al. | 15/256.5 |
| 4,937,633 | 6/1990 | Ewing | 355/299 |
| 5,145,724 | 9/1992 | Yanai et al. | 355/299 X |

FOREIGN PATENT DOCUMENTS

| | | | |
|---|---|---|---|
| 0460658 | 12/1991 | European Pat. Off. | 355/299 |
| 0052273 | 3/1984 | Japan | 355/299 |
| 0287483 | 11/1990 | Japan | 355/299 |
| 0081793 | 4/1991 | Japan | 355/299 |
| 0212190 | 8/1992 | Japan | 355/299 |
| 0260084 | 9/1992 | Japan | 355/299 |

*Primary Examiner*—Matthew S. Smith

*Attorney, Agent, or Firm*—Fitzpatrick, Cella, Harper & Scinto

[57] ABSTRACT

A blade device for use in contact with an object such as an image-carrying photosensitive drum of an image forming apparatus. The blade device has a blade body made of urethane rubber, a surface coating layer and an underlying primer layer between the surface coating layer and the blade body, the primer layer covering an area of the blade body more extensive than that covered by the surface coating layer, the surface coating layer being provided on the region of the primer layer which is closer to the object than is a portion of the blade body where stresses are concentrated when the blade is held in contact with the object.

18 Claims, 9 Drawing Sheets

BLADE DEVICE AND IMAGE FORMING APPARATUS

BACKGROUND OF THE INVENTION

1. Field of the Invention

The present invention relates to a blade device which contacts an object in, for example, an image forming apparatus and also to an image forming apparatus using such a blade device.

2. Description of the Related Art

A cleaning device which contacts and cleans an image carrying surface of a component of an image forming apparatus will be described, as a typical example of the blade device to which the present invention pertains.

In general, an image forming apparatus such as a copying apparatus incorporates an image carrier. The surface of the image carrier is initially charged uniformly and is selectively exposed to light from an original image so that an electrostatic latent image is formed on this surface. This latent image is then developed to become a visible image by means of a toner, and thus formed toner image is transferred to a recording member, whereby the original image is recorded. Any residue remaining on the image carrier after the transfer of the image, such as the paper dust, lubricant contained in the toner and so forth, are removed by a cleaning device.

A typical cleaning device includes a cleaning blade made of an elastic material such as urethane rubber. The blade is held in contact with the image carrier during rotation of the image carrier, so as to scrape the above-mentioned residue off the image carrier. The toner which is being scraped serves as a lubricant between the image carrier surface and the blade edge, so that the cleaning blade can maintain a constant position relative to the image carrier during the scraping.

It is to be understood, however, that the image having an extremely low image density is formed, friction between the image carrier and the blade is drastically increased due to shortage of the toner which would function as the lubricant. Consequently, the end of the blade tends to be turned up or locally damaged as the image carrier rotates. This problem is serious particularly when the image carrier is an OPC photosensitive drum having a surface layer made of a polymeric resin such as polycarbonate, because the blade made of urethane rubber exhibits a very large coefficient of friction when used in contact with such a polymeric resin, thus enhancing the tendency of turnino up or local damaging of the blade edge. This problem also is serious in full-color copying apparatus in which the blade has to be kept in contact with the image carrier at a higher contact pressure than in ordinary copying apparatuses.

FIG. 9 shows an arrangement proposed for the purpose of the above-described problem. In this arrangement, a toner reservoir 52 is disposed upstream of a cleaning blade 50 as viewed in the direction of rotation of an image carrier 51, so that the toner 53 scraped off by the blade 50 is brought into contact with the image carrier 51 so as to function as the lubricant.

The arrangement shown in FIG. 9, however, is still unsatisfactory in that only a small amount of the toner is collected in the reservoir when a number of images of low levels of image density are successively formed. In such a case, the above-mentioned problems such as turning up or local damaging of the blade edge are caused due to insufficient lubrication. In particular, a large friction between the blade 50 and the image carrier 51 is developed in the regions outside the image forming area, typically at both longitudinal ends of the blade 50, because the toner which would function as the lubricant does not exist in such regions. Consequently, the blade 50 serves as a brake which brakes the rotating image carrier 51, thus making the rotation of the image carrier 51 unstable, while allowing vibration or turning up of the edge of the cleaning blade 50.

It has also been proposed to reduce the friction by applying a fluoro-resin powder such as PTFE or PVD on the end of the blade 50 where the blade 50 contacts the image carrier 51. Such fluoro-resin powder, however, is consumed away during long use of the copying apparatus, resulting in an increase in the friction between the blade 50 and the image carrier 51.

Rubbers also are often used as the material of the elastic blade. A blade made of a rubber, however, suffers from a problem in that the blade becomes fragile due to hydrolysis so that the surface of the blade undesirably allows the residue on the image carrier to pass the nip between the blade and the image carrier. Even an urethane rubber, which exhibits a comparatively small tendency of degradation due to hydrolysis, experiences inferior cleaning due to hydrolysis as shown below, after 2 to 3 years of continuous use.

$$(O—C—NM\ (P)+H_2O)\ OH+CO_2+NH_2\ (P)$$

The degradation of the rubber blades such as deterioration of surface state and reduction in the elasticity is also caused by corona products such as nitrogen oxides or ozone generated by a charger during the operation of the image forming apparatus.

SUMMARY OF THE INVENTION

In view of the above-described problems of the known arts, an object of the present invention to provide a blade device in which degradation of the elastic blade is suppressed to eliminate any turn up or local damaging of the blade even after a long use.

Another object of the present invention is to provide an image forming apparatus in which deterioration of image due to inferior cleaning is remarkably suppressed.

Still another object of the present invention is to provide a blade device which suppresses reduction in the elasticity of a blade.

A further object of the present invention is to provide an image forming apparatus which is improved to eliminate damaging of the surface of an image carrier attributable to contact with a cleaning blade.

According to one aspect of the present invention, there is provided a blade device for use in contact with an object, comprising: a resilient and elastic blade body; and a supporting member for supporting the blade body at the side of the blade body opposite to the side contactable with the object; wherein the blade body has a surface coating layer and an underlying primer layer between the surface coating layer and the blade body, the primer layer covering an area of the blade body wider than that covered by the surface coating layer, the surface coating layer being provided on the region of the blade body which is closer to the object than is a portion of the blade body where stresses are concentrated when the blade is held in contact with the object.

According to another aspect of the present invention, thee is provided an image forming apparatus such as a copying machine, laser beam printer or the like, wherein the blade device having the features set forth above is combined with an image carrier.

These and other objects, features and advantages of the present invention will become clear from the following description of the preferred embodiments when the same is rad in conjunction with the accompanying drawings.

BRIEF DESCRIPTION OF THE DRAWINGS

FIG. 2 (*b*) is an enlarged sectional view of the first embodiment of the blade device;

FIG. 3 (*b*) is an enlarged sectional view of the third embodiment of the blade device;

FIG. 6(*b*) is an enlarged sectional view of a fifth embodiment of the blade device of the present invention;

FIG. 7 (*b*) is an enlarged sectional view of the sixth embodiment of the blade device;

FIG. 7 (*c*) is an illustration of a modification of the blade device shown in FIG. 7 (*b*);

FIG. 8 (*b*) is an exploded view of the seventh embodiment of the blade device;

FIG. 8(*c*) is a perspective view of the seventh embodiment of the blade device as viewed from the side where it contacts with the photosensitive drum.

DESCRIPTION OF THE PREFERRED EMBODIMENTS

A description will now be given of a first embodiment of the blade device of the present invention used as a cleaning device and also of an image forming apparatus incorporating such a cleaning device, with reference to the accompanying drawings.

Figure 1:
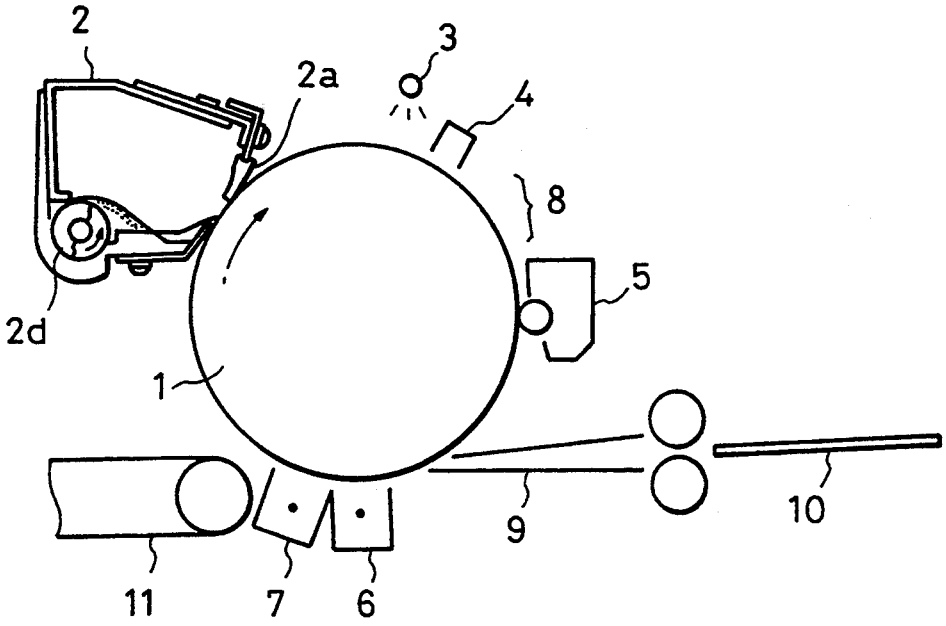
FIG. 1 is a schematic illustration of an image forming apparatus using a blade device in accordance with the present invention.

The outline of the image forming apparatus will be briefly described with specific reference to FIG. 1 which illustrates the construction of a copying apparatus as an example of the image forming apparatus to which the present invention pertains. A reference also is made to FIG. 2(*a*) which is an illustration of the cleaning device, and to FIG. 2(*b*) which illustrates the construction of a cleaning blade.

The image forming apparatus has a photosensitive drum 1 which serves as an image carrier and which rotates in the direction of the arrow in FIG. 1. A cleaning device 2 as cleaning means is held in contact with the photosensitive drum 1. More specifically, the cleaning device 2 has a cleaning blade 2*a* which is pressed into contact with the surface of the photosensitive drum 1. Components which in cooperation perform a series of steps of electrophotographic process are arranged around and in the vicinity of the photosensitive drum 1. These components are: a pre-exposure light source 3, a primary charger 4, a developing device 5, a transfer charger 6 and a separation charger 7.

In operation, the surface of the photosensitive drum 1 passes through the region under the pre-exposure light source 3 in accordance with the rotation of the photosensitive drum 1, so that any residual electrostatic charges are removed from the surface of this portion of the photosensitive drum 1. The surface of the photosensitive drum then passes through the region under the primary charger 4 so as to be uniformly charged. The surface of the photosensitive drum 4 then passes through a region 8 where it is exposed to image light, whereby an electrostatic latent image is formed. The latent image is then developed by a toner as the surface carrying the latent image passes through the region under the developing device 5, and the thus-formed toner image is transferred by the transfer charger 6 to the surface of a recording member 10 which is conveyed through a passage 9. The recording member 10 now carrying the image transferred thereto is separated from the photosensitive drum 1 and is conveyed by conveyor means 11 to a fixing station (not shown) where the toner image is fixed to the recording member 10.

The portion of the toner which has not been transferred to the recording member 10 remain on the surface of the photosensitive drum 1 so as to be conveyed to the cleaning device 2 in accordance with the rotation of the photosensitive drum 1.

Figure 2A:
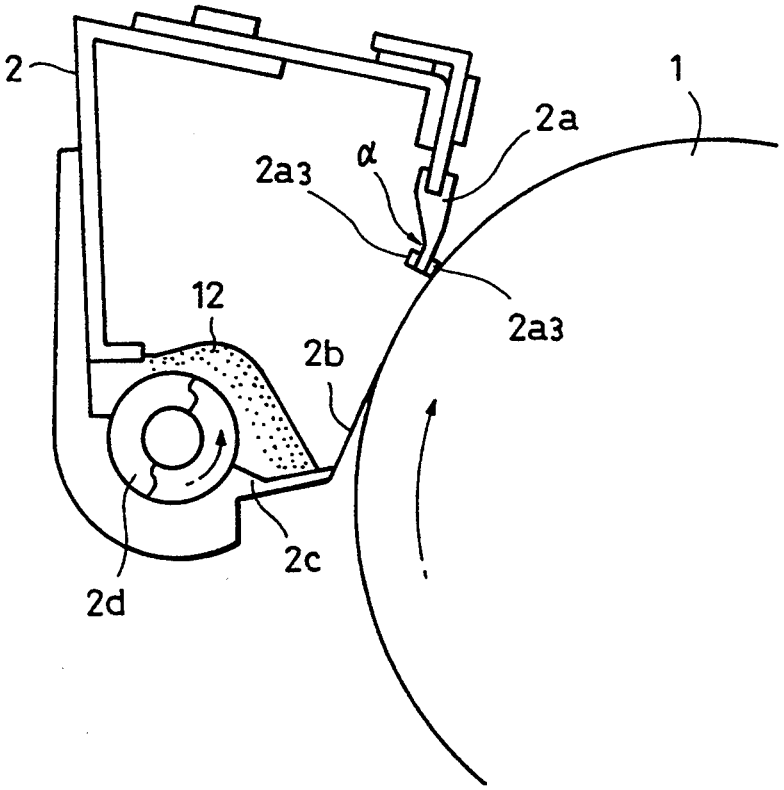
FIG. 2 (*a*) is an illustration of a cleaning device using a first embodiment of the blade device of the present invention.
Figure 2B:
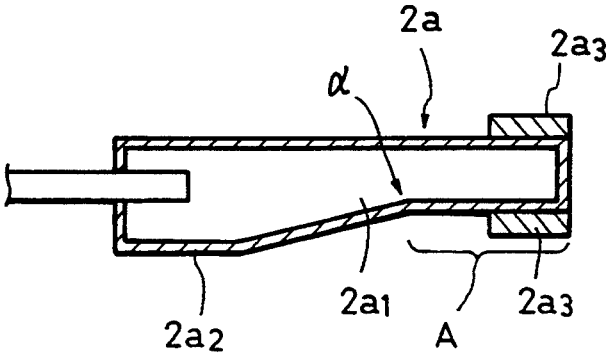

As shown in FIG. 2(*a*), the cleaning device 2 has a cleaning blade 2*a* contacting the peripheral surface 2*f* the photosensitive drum 1. The residual toner is therefore scraped by the blade 2*a* off the surface of the photosensitive drum 1 and is collected in a toner reservoir 2*c* through a chute 2*b*. The toner 12 collected in the toner reservoir 2*c* is conveyed to a waste toner container (not shown) by means of a screw conveyor 2*d* which rotates in the direction of the arrow depicted upon screw conveyor 2*d* in FIG. 2(*a*).

A urethane rubber 2*a*1, which excels in anti-chemical and anti-wear properties, as well as in mechanical strength, is used as the material of the cleaning blade 2*a*. The end of the cleaning blade 2*a* contacting the surface of the photosensitive drum 1 is progressively worn down due to friction during the operation of the image forming apparatus.

To obviate this problem, the first embodiment of the present invention employs a coating layer 2*a*3 which is provided on the portion of the blade 2*a* contactable with the photosensitive drum 1 and which serves to reduce the friction between the blade 2*a* and the photosensitive drum 1. The coating layer 2*a*3 is formed by dispersing lubricant particles (graphite fluoride) in a nylon resin solution and applying to the surface of the urethane rubber 2*a*1 followed by drying. The coating layer 2*a*3 on the surface of the blade 2*a* may be ground due to sliding contact with the photosensitive drum 1.

However, the lubricant particles contained in the coating layer 2a3 are deposited to the surface of the photosensitive drum 1 so as to reduce the friction between the cleaning blade 2a and the photosensitive drum 1. It has been confirmed through experiments that, in order that the coating layer 2a3 has a sufficiently large durability against wear caused by sliding contact between the coating layer 2a3 and the photosensitive drum 1, the thickness of the coating layer 2a3 should be 10 μm at the smallest.

It would be possible to coat the entire surface of the urethane rubber by the coating layer 2a3, in order to suppress hydrolysis of the urethane rubber. Coating of the entire surface with the nylon resin of 10 μm or thicker, however, makes the whole blade 2a too stiff or rigid, thus affecting the resiliency of the blade which is necessary for maintaining good contact between the blade 2a and photosensitive drum 1.

When such a coating layer is formed, therefore, it is necessary that the pressure of contact between the urethane rubber blade and the photosensitive drum 1 is set to a level which is higher than that required in the cleaning device which does not have any such coating layer, if an equivalent cleaning effect is to be attained. The elevated pressure of contact, however, adversely affects the durability of both the photosensitive drum 1 and the cleaning blade 2.

In the embodiment under description, therefore, the entire surface of the urethane rubber 2a1 is coated by an underlying layer 2a2 of a thickness smaller than the thickness of the above-mentioned coating layer 2a3 so as to make the whole urethane rubber 2a1 resistant to degradation due to hydrolysis, and a slippery coating layer 2a3 of 10 μm or thicker, containing lubricant particles, is formed on the underlying layer 2a2 at the portion where the blade 2a contacts with the surface of the photosensitive drum 1, thus improving durability of the blade 2a against the wear which occurs due to sliding contact with the surface of the photosensitive drum 1.

The described construction of the cleaning blade 2a effectively suppresses undesirable turn-up or local damaging of the end of the blade 2a, while avoiding any degradation of the blade material due to hydrolysis, without causing any substantial change in the resiliency and elasticity of the whole blade. Consequently, cleaning operation and image forming operation are stably performed in the image forming apparatus which employs the described cleaning device in accordance with the present invention.

Preferably, the coating layer 2a3 is provided on the portion of the blade 2a which is closer to the photosensitive drum 1 than is the portion α where the stresses generated in the blade 2a are concentrated when the blade 2a is pressed into contact with the photosensitive drum 1 under a required pressure. Such an arrangement effectively prevents the contact pressure from becoming excessively large.

Furthermore, the second coating layer 2a2 which covers the area of the blade 2a greater than that covered by the surface coating layer 2a3 effectively prevents deterioration of the blade 2a2 which otherwise may be caused by hydrolysis.

In view of the resiliency and elasticity of the blade 2a, the thickness of the second coating layer 2a2 is preferably selected to range from 0.1 μm to 10 μm, more preferably from 0.5 μm to 5 μm.

On the other hand, the thickness of the surface coating layer 2a3 is determined preferably to fall within the range of 10 μm to 30 μm, more preferably 10 μm to 20 μm, in order to satisfy requirements from the viewpoint of durability.

The lubricant particles used in the present invention may be particles which are broadly used as solid lubricants, such as particles of inorganic or organic particles. Examples of inorganic material are talc, calcium carbonate, molybdenum disulfide, silica dioxide and graphite. Examples of the organic material are fluororesin, nylon resin (polyamide), silicone resin, polyacetal resin and so forth. Both in inorganic and organic materials, fluoric compounds are preferably used because of small values of coefficient of friction exhibited by such compounds.

Examples of the fluoric compound powder are graphite fluoride, polyvinylidene fluoride resin, ethylene tetrafluoride, ethylene tetrafluoride-propylene hexafluoride copolymer, ethylene tetrafluoride-perfluoroalkoxyethylene copolymer, trifluoro ethylene chloride, and ethylene tetrafluoride-ethylene copolymer.

An experiment was conducted to examine the effect of the described embodiment, using an image forming apparatus having an OPC photosensitive drum with a surface layer made of a material containing a binder of polycarbonate as a polymeric resin, a cleaning blade made of an urethane rubber, and a developing device which employs a component toner composed of magnetic particles and a nonmagnetic toner mainly constituted by a polyester resin. As a result, it was found that graphite fluoride, which has infinite flake-like crystalline form and which exhibits low coefficient of friction, is used specifically suitably.

Although not exclusive, the graphite fluoride may be SEFBON DM (produced by Central Glass Co., Ltd) which is of $(C_2F)_n$ type, SEFBON CMA and SEFBON CMF (both produced by Central Glass Co;, Ltd.) which are of $(CF)_n$ type, Fluorocarbons #2065, #1030 and #1000 (produced by Asahi Glass Co., Ltd. ) , CF-100 (produced by Nippon Carbon Co. , Ltd.) fluorocarbons #2028 and #2010 (produced by Asahi Glass Co., Ltd.) of (CF)n type with modified fluorination ratio, and any one of the foregoing graphite fluoride with the surface fluorine removed through treatment with a base such as amine.

In order to ensure high toner cleaning effect, the average particle size of the lubricant particles is preferably not greater than 10 μm.

The binder resin used in the present invention may De of any type which is ordinarily used as a coating agent. Considering that the binder forms the coating layer on the surface of the body of the cleaning blade for use in pressure contact with the photosensitive drum, the binder resin preferably is a resin which has a specifically low coefficient of friction. Examples of such a binder resin are: nylon resin (polyamide), silicone resin, polyacetal resin and fluororesin. The coating on the blade can be done by preparing the resin such as nylon resin in a suitable solvent such as an alcohol thus preparing a solution, dispersing powder of graphite fluoride in the solution, and depositing the dispersion solution to the polyurethane rubber in a predetermined thickness by means of a brush or a coater or by dipping the polyurethane rubber in the solution. Although an alcohol is specifically mentioned as the solvent, any other solvent which can dissolve nylon resin and which permits uniform dispersion of fluoric compound can be used as the solvent.

The use of the binder resin dispersing the above-mentioned lubricant particles effectively reduces the friction between the photosensitive drum 1 and the blade, without impairing the cleaning effect. This coating material, however, exhibits a rather inferior closeness or rightness of adhesion to the urethane rubber 2a1, thus posing a risk of exfoliation from the surface of the urethane rubber. It is therefore advisable to provide, between the urethane rubber 2a1 and the coating layer 2a2 or, alternatively, in place of the coating layer 2a2, a nylon-type primer layer which functions as an adhesive layer, thereby preventing separation of the coating material which forms the surface layer. The thickness of the primer layer may be as small as several μm, so that the elasticity of the whole blade is not changed significantly even when the entire surface of the blade is converted by this primer layer.

Figure 3:
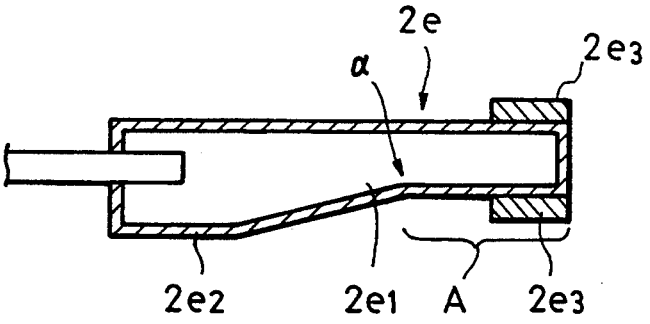
FIG. 3 is a sectional view of a second embodiment of the blade device of the present invention.

FIG. 3 shows a second embodiment of the blade device of the present invention. In this blade device 2e, a primer layer 2e2 of several μm thick, serving as an adhesive layer, is formed in place of the second coat in a layer 2a2 used in the first embodiment, so as to cover the entire surface of the blade. The sliding layer 2e3 of 10 μm or thicker, formed of the aforesaid binder resin containing lubricant particles dispersed therein, is formed on the primer layer.

In this second embodiment of the blade device 2e, the primer layer 2e2 covers a large area of the surface of the urethane rubber 2e1 so as to effectively prevent degradation of the blade due to, for example, hydrolysis. In addition, the surface coating layer 2e3 is formed on the portion of the blade which is closer to the photosensitive drum 1 than is the point α where the stresses are concentrated when the blade is held in pressure contact with the photosensitive drum, so that the resiliency or elasticity of the blade is not substantially affected by the provision of the surface coating layer 2e3. A greater strength of bonding is obtained between the primer layer 2e2 and the surface coating layer 2e3, provided that the primer layer 2e2 is made of a resin of the same type as that used as the material of the surface coating layer 2e3.

Figure 4A:
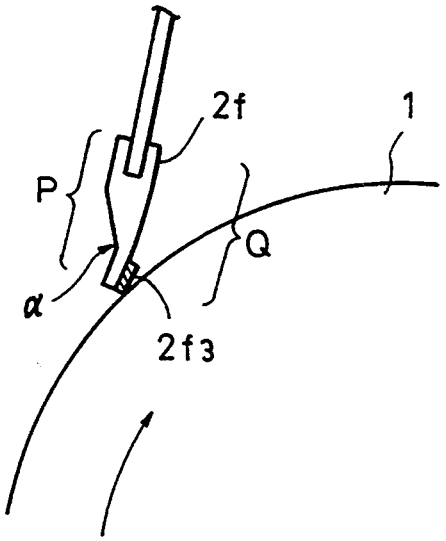
FIG. 4 (*a*) is an illustration of a cleaning device incorporating a third embodiment of the blade device of the present invention.
Figure 4B:
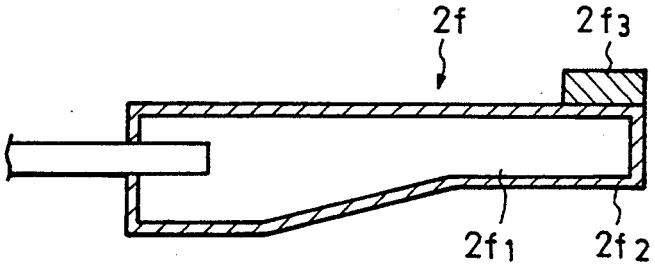

FIGS. 4 (*a*) and 4 (*b*) show a third embodiment in which the sliding layer, i.e., the surface coating layer, 2f3 is formed only on one side of the urethane rubber, particularly on the side of the urethane rubber 2f1 which faces the photosensitive drum. FIG. 4 (*a*) is an illustration explanatory of the cleaning blade 2f of the cleaning device 2, while FIG. 4 (*b*) is an illustration of the construction of the cleaning blade. In these Figures, the same reference numerals are used to denote the same parts or members as those appearing in the preceding embodiment shown in FIG. 3.

Referring to FIGS. 4 (*a*) and 4 (*b*), the cleaning blade 2f has a blade body made of urethane rubber 2f1, a primer layer 2f2 of a thickness not greater than several μm and serving as a bonding layer formed on the entire area of the urethane rubber 2f1, and a sliding layer, i.e., the surface coating layer 2f3 which is formed on the portion of the side of the urethane rubber 2f1 which contacts the photosensitive drum 1.

When the cleaning blade 2f is held in contact with the photosensitive drum 1, the urethane rubber is resiliently deformed in response to the contact pressure. The bending stress generated in the urethane rubber 2f1 is concentrated to a point denoted by α on the side P of the cleaning blade 2f which is compressed as a result of the bending. Provision of the sliding surface 2f3 which is as thick as 10 μm or greater on this side P of the cleaning blade will cause a stress concentration to an area where the sliding surface 2f3 terminates on the blade side P. In view of this fact, as shown in FIG. 4 (*b*), the embodiment under description employs the sliding layer 2f3 which is formed only on the side Q of the blade which is contactable with the surface of the photosensitive drum, thereby preventing concentration of stress which otherwise would be caused on a point on the compressed side of the blade 2f, thus achieving improved durability of the cleaning blade 2f.

Figure 5:
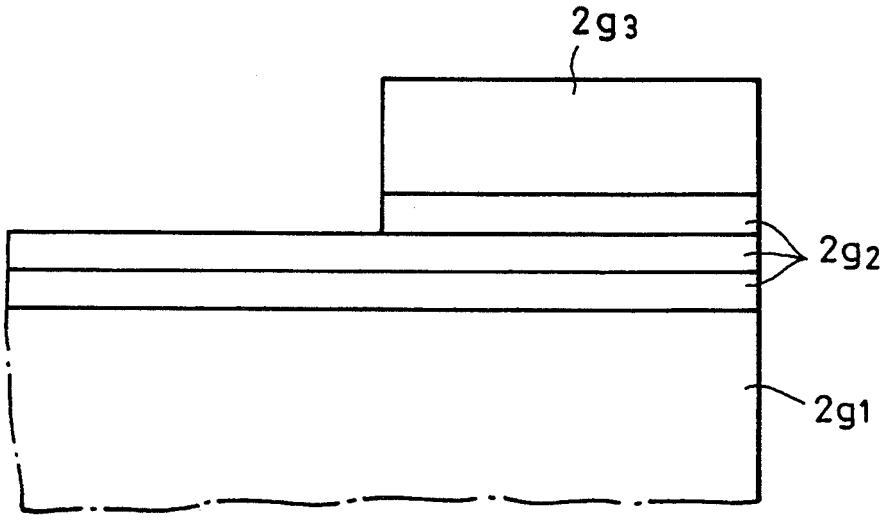
FIG. 5 is an enlarged sectional view of a fourth embodiment of the blade device of the present invention.

The embodiment shown in FIGS. 4 (*a*) and 4 (*b*) employs only one primer layer. This, however, is only illustrative and the primer layer may be composed of a plurality of layers, in order to attain a greater strength of bonding between the urethane rubber and the sliding layer. FIG. 5 shows a fourth embodiment of the present invention in which, in order that a greater bonding strength is developed between the urethane rubber 2g1 and the sliding layer 2g3, the coating layer 2g2 as the bonding layer is formed of a plurality of layers. In such a case, only one or more of such plural layers constituting the bonding layer may cover the entire surface of the urethane rubber 2g1.

Figure 6A:
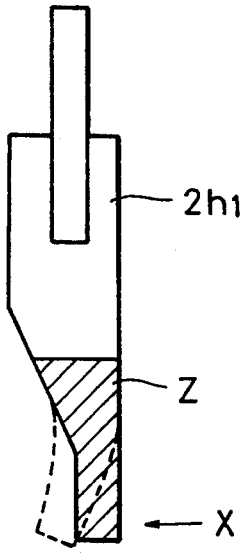
FIG. 6(*a*) is an illustration of a blade which has been deformed under a force acting in a direction X.
Figure 6B:
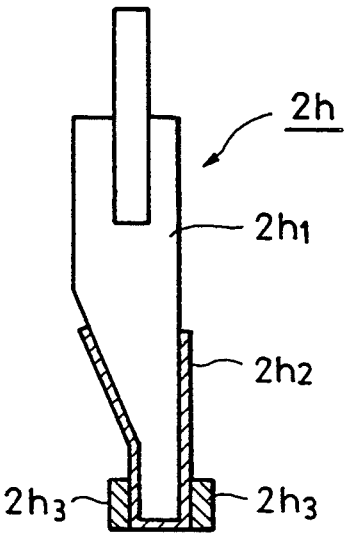

In the embodiments described hereinbefore, the entire surface of the urethane rubber is wholly coated by at least one thin coating layer. This, however, is not essential and the thin coating layer may be formed only on the portion of the urethane rubber where the effect of provision of such thin layer for preventing degradation due to hydrolysis or deposition of corona products is remarkable. Referring to FIG. 6(*a*), when a chip-shaped urethane rubber 2h1 is used as the blade under a force acting in the direction of the arrow X in this Figure, urethane rubber 2h1 is deformed from a state shown bV solid line into a state shown by broken line. Consequently, hatched region Z of the urethane rubber 2h1 exhibits a specifically large deformation and, hence, is liable to degraded due to hydrolysis or action of ozone and nitrogen oxides, posing a risk of serious deterioration in the cleaning performance.

In a fifth embodiment of the present invention, as shown in FIG. 6(*b*), the coating layer 2h2 is formed only on the surface of the region Z so as to prevent degradation of urethane rubber in this region, thus attaining an effect substantially equivalent to that attained when the entire area of the urethane rubber 2h1 is coated.

Figure 7A:
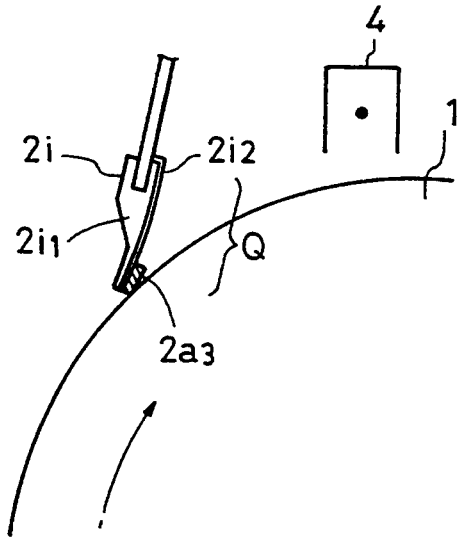
FIG. 7 (*a*) is an illustration of a cleaning device incorporating a sixth embodiment of the blade device of the present invention.
Figure 7B:
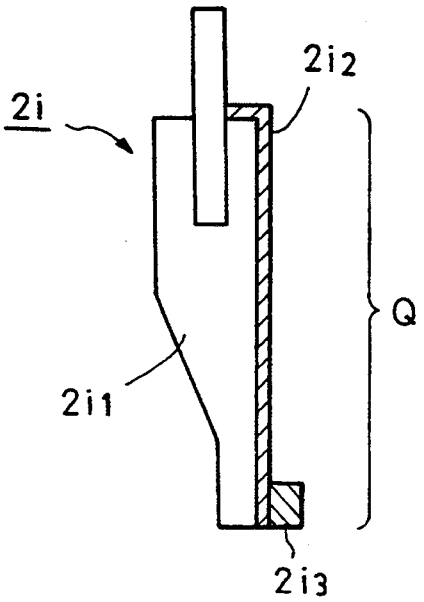
Figure 7C:
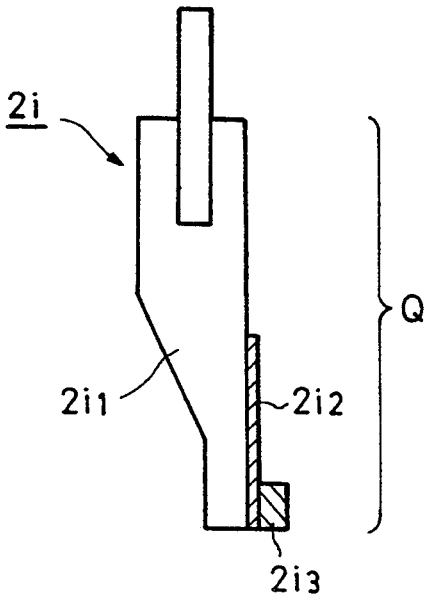

Referring to FIG. 7(*a*), the side Q of the cleaning blade 2i is more liable to be deteriorated by corona products such as nitrogen oxides and ozone generated by the charger 4, as compared with the other side P, because the blade 2i faces the charger 4 at its side Q. In a sixth embodiment of the present invention, therefore, the thin coating layer 2i2 is formed only on the side Q of the cleaning blade 2i. In a modification shown in FIG. 7(*c*), the coating layer 2i2 is formed only on a portion of the side Q of the cleaning blade 2i which undergoes the heaviest stress concentration.

In the embodiments described hereinbefore, the thickness of the elastic blade varies such that it is progressively reduced from the base end near a blade holder towards the end contactable with the photosensitive drum. In an eighth embodiment of the present invention, however, the thickness of the blade is constant over the entire length of the blade from the base end to the end contactable with the photosensitive drum.

Figure 8A:
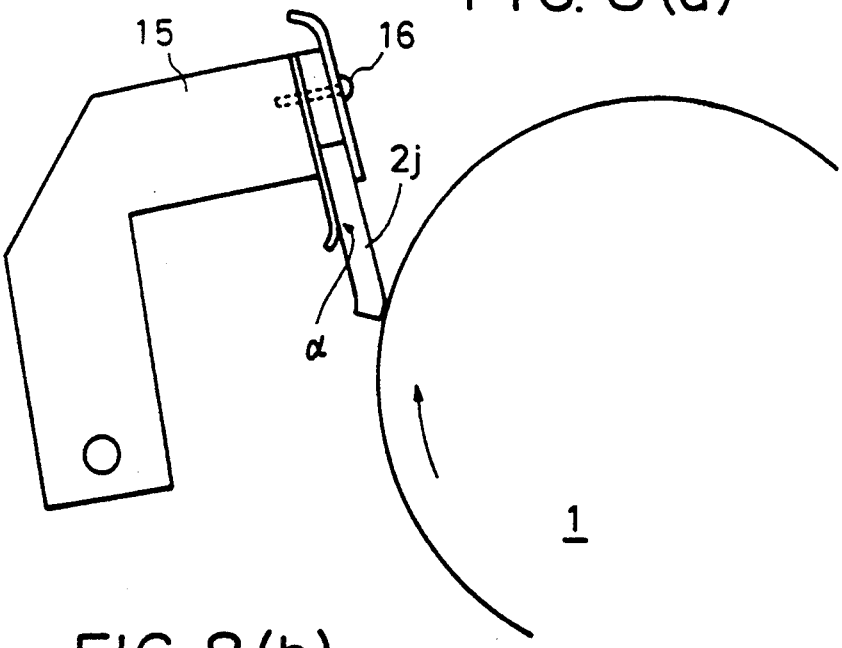
FIG. 8(*a*) is an illustration of a cleaning device incorporating a seventh embodiment of the blade device of the present invention.
Figure 8B:
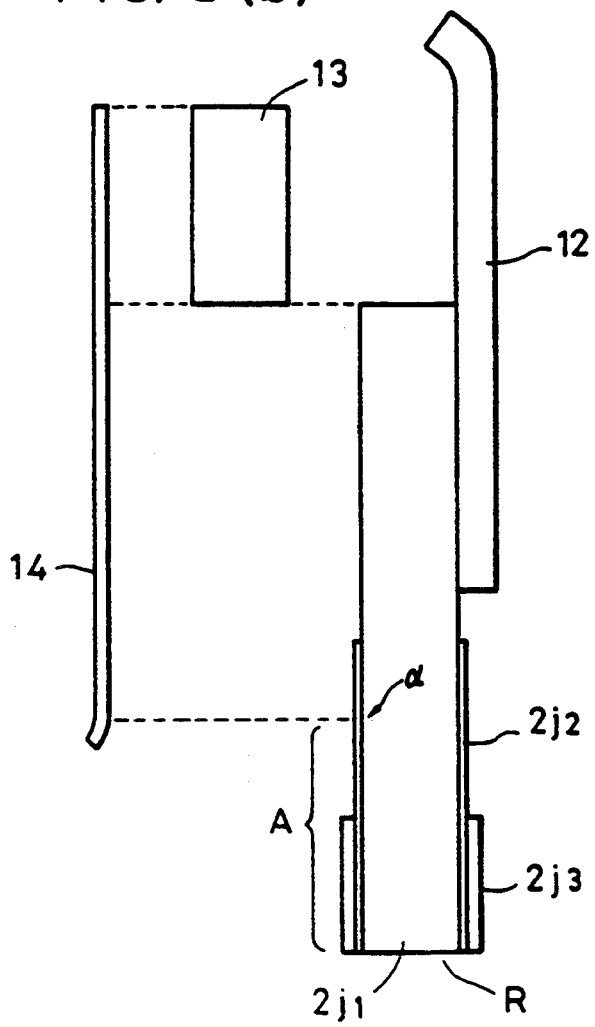
Figure 8C:
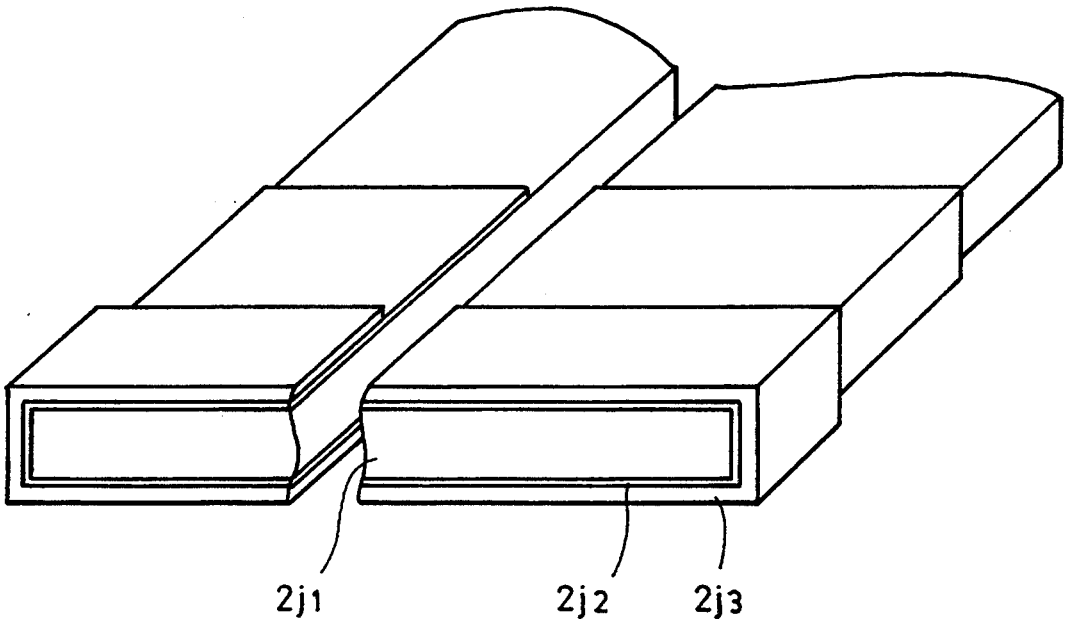
Figure 9:
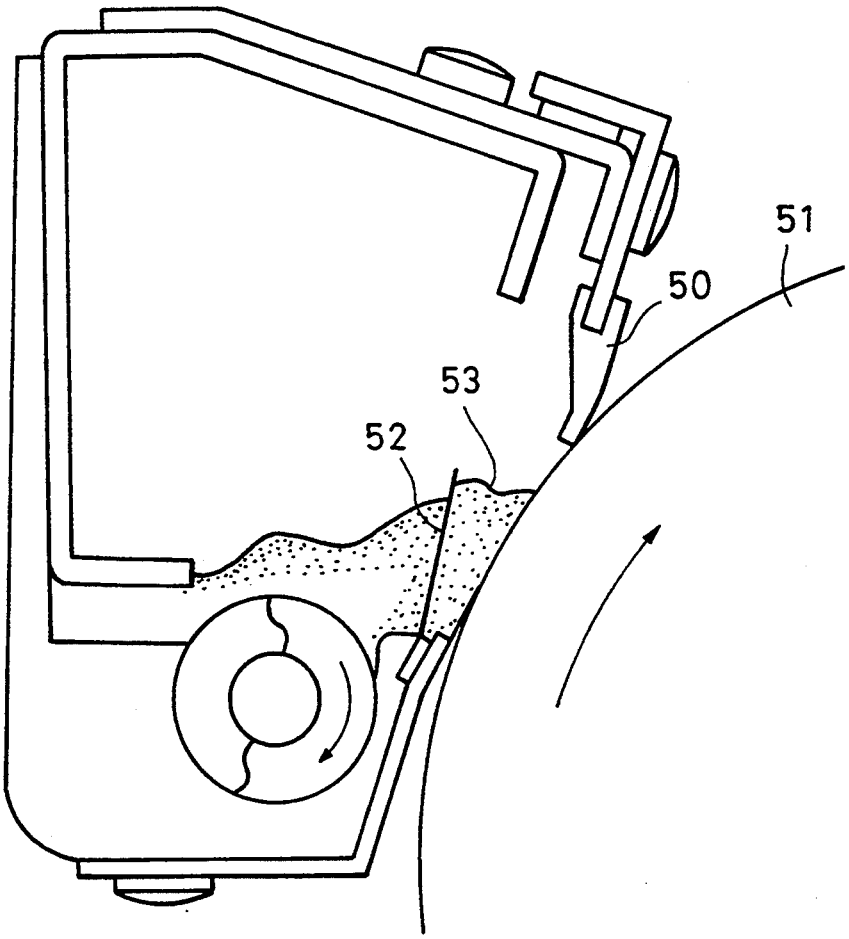
FIG. 9 is an illustration of a cleaning device incorporating a known blade device.

FIG. 8 (*a*) illustrates a state in which the above-described blade **2*j* is held in contact with the photosensitive drum 1**, while FIG. 8 (*b*) is an exploded view of the blade device shown in FIG. 8 (*a*) .

As shown in FIG. 8(*a*), a blade **2*j* is held in contact with the photosensitive drum 1 at a predetermined pressure in such a manner as to project in the direction counter to the direction of rotation of the photosensitive drum 1. As will be seen from FIGS. 8**(*a*) and 8(*b*), the blade **2*j* is supported by a blade fixing member 15 through a sheet metal 14, typically an SUS plate of about 0.1 mm thick, and is fixed to the fixing member 15 together with a spacer 13 and a blade holder 12, typically a sheet metal of 1.6 mm thick, by means of a screw 16**.

The sheet metal 14 supports the blade **2*j* at the side of the latter opposite to the side contactable with the photosensitive drum 1, thus ensuring that the blade 2*j* is pressed onto the photosensitive drum 1** at a predetermined pressure.

A description will now be given of a method of forming coating layers **2*j*2 and 2*j*3 on the blade 2*j*1**.

A solution prepared by dissolving a nylon resin in an alcohol is applied by dipping onto the side of the blade **2*j*1 of urethane rubber contactable with the photosensitive drum 1. The solution is then dried so that the solvent is evaporated, whereby a primer layer 2*j*2 of nylon resin is formed on the above-mentioned side of the blade 2*i*1. 3in addition, a solution prepared by dissolving a nylon resin in an alcohol as a solvent and containing carbon fluoride powder particles dispersed therein is applied by dipping the blade surface on which the primer layer 2*j*2** of nylon resin has been formed. The solution is then dried to allow the alcohol to evaporate.

The end of the blade on which the coating layers **2*j*2, 2*j*3 have been formed is cut at a plane R shown in 8**(*b*), whereby the blade **2*j* is obtained. FIG. 8**(*c*) is a perspective view of the thus-obtained blade **2*j* as viewed from the edge of the blade on the side of the blade 2*j* contactable with the photosensitive drum 1**.

Polyurethane rubber **2*j*1** is exposed when the blade is cut at the plane R, so that the resistance of the blade to degradation is somewhat inferior. However, the edge of the blade contactable with the photosensitive drum can be finished with a higher degree of precision.

The stress applied to the blade **2*j* is concentrated the border $\alpha$ between the portion of the blade 2*j* supported by the sheet metal 14 and the portion of the same which not supported by the sheet metal 14. It is therefore necessary that the surface coating layer 2*j*3 is formed within a region A which is between the border $\alpha$ and the blade end contactable with the photosensitive drum, in order that the resiliency of the blade 2*j* is not impaired. On the other hand, the primer layer 2*j*2 does not cause substantial change in the elasticity of the blade 2*j*, so that this layer may cover an area wider than that covered by the surface coating layer 2*j*3. Thus, the primer layer 2*j*2 may spread towards the holder 12** beyond the border $\alpha$.

Preferably, a solution formed by dissolving a nylon resin of a small molecular weight in an alcoholic solvent is used as an adhesive for bonding between the blade **2*j*i of an urethane rubber and the surface layer 2*j*3 of a nylon resin. Needless to say, the nylon resin of small molecular weight exhibits a high degree of closeness of contact with the nylon resin of the surface coating layer 2*j*3** and also exhibits good adhesion to the urethane rubber because it has a molecular structure similar to urethane rubber.

The primer layer **2*j*2 formed by the described process exhibited a tensile elasticity modulus of 2000 kg/cm$^2$, while the surface coating layer 2*j*3 exhibited a tensile elasticity modulus of about 5000 kg/cm$^2$. The thickness of the urethane blade 2*j*1 was about 2 mm, while the thickness of the primer layer 2*j*2 and the surface coating layer 2*j*3** were about 3 $\mu$m and about 15 $\mu$m, respectively.

In the embodiment described before, the cleaning device 2 as an independent component is incorporated in the image forming apparatus. This, however, is only illustrative and the cleaning device 2 as the blade device of the present invention may be constructed as a unit with the photosensitive drum 1 to form a cartridge which is detachably mounted in the image forming apparatus.

Although a copying apparatus has been specifically mentioned as the image forming apparatus, the present invention can equally be applied to other types of image forming apparatuses such as a laser beam printer.

As will be understood from the foregoing description, the present invention provides a blade device having a resilient and elastic blade body, a surface coating layer provided on a portion of the blade body near the blade end contactable with an object such as a photosensitive drum, and a second or underlying coating layer provided between the blade body and the surface coating layer and covering an area of the blade body wider than that covered by the surface coating layer, the surface coating layer being disposed on a portion of the blade body closer to the contact object than is the portion of the blade body where stress is concentrated when the blade is held in pressure contact with the object. Consequently, degradation of the blade due to hydrolysis and other effects can be avoided without unnecessarily stiffening the blade.

The object with which the blade of the blade device of the present invention contacts is not limited to a photosensitive drum. For instance, the blade device of the present invention may be used in cooperation with the fixing roller or other components which are to be contacted by a blade.

Although the invention has been described through its specific forms, it is to be understood that the described embodiments are only illustrative and various changes and modifications may be imparted thereto without departing from the scope of the present invention which is limited solely by the appended claims.

What is claimed is:

1. A blade device for use in contact with an object, comprising:

an elastic blade body; and a supporting member for supporting said blade body at the side of said blade body opposite to the side contactable with said object;

wherein said blade body has a surface coating layer and an underlying primer layer between said surface coating layer and said blade body, said primer layer covering an area of said blade body more extensive than that covered by said surface coating layer, said surface coating layer being provided on the region of said primer layer which is closer to said object than is a portion of said blade body where stresses are concentrated when said blade is held in contact with said object.

2. A blade device according to claim 1, wherein the thickness of said blade body varies such that the thickness is smaller at the end of said blade body contactable with said object than at the end of said blade body adjacent to said supporting member.

3. A blade device according to claim 1, wherein said surface coating layer has a thickness greater than that of said primer layer.

4. A blade device according to claim 1, wherein said blade body is made of a urethane rubber.

5. A blade device according to claim 1, wherein said surface coating layer is a nylon layer.

6. A blade device according to claim 1, wherein said surface coating layer contains lubricant particles.

7. A blade device according to claim 6, wherein said lubricant particles are fluoro-carbon particles.

8. A blade device according to claim 1, wherein said surface coating layer and said primer layer extend from the end of said blade body contactable with said object towards the end of said blade body adjacent to said supporting member.

9. An image forming apparatus, comprising:

an image carrier; and a cleaning blade contacting with said image carrier to remove residue on said image carrier;

wherein said cleaning blade has an elastic blade body, a surface coating layer, and an underlying primer layer between said surface coating layer and said blade body, said primer layer covering an area of said blade body more extensive than that covered by said surface coating layer, said surface coating layer being provided on the region of said primer layer which is closer to said image carrier than is a portion of said cleaning blade where stresses are concentrated when said cleaning blade is held in contact with said image carrier.

10. An image forming apparatus according to claim further comprising a supporting member supporting said cleaning blade at the side of said cleaning blade opposite to the side contactable with said image carrier.

11. An image forming apparatus according to claim wherein the thickness of said cleaning blade varies such that the thickness is smaller at the end of said cleaning blade than at the end of said cleaning blade adjacent said supporting member.

12. An image forming apparatus according to claim 9, wherein said surface coating layer has a thickness greater than that of said primer layer.

13. An image forming apparatus according to claim 9, wherein said blade body is made of a urethane rubber.

14. An image forming apparatus according to claim 9, wherein said surface coating layer is a nylon layer.

15. An image forming apparatus according to claim 9, wherein said surface coating layer contains lubricant particles.

16. An image forming apparatus according to claim 15, wherein said lubricant particles are fluoro-carbon particles.

17. An image forming apparatus according to claim 9, wherein both said surface coating layer and said primer layer spread from the end of said cleaning blade contactable with said image carrier towards the end of said cleaning blade adjacent to said supporting member.

18. An image forming apparatus according to claim 9, wherein said image carrier is a rotatable drum-shaped member and said blade contacts with the surface of said image carrier so as to project in the direction counter to the direction of rotation of said image carrier.

* * * * *

UNITED STATES PATENT AND TRADEMARK OFFICE

CERTIFICATE OF CORRECTION

PATENT NO. : 5,363,182

DATED : November 8, 1994

INVENTOR(S) : IKUO KURIBAYASHI, ET AL.

It is certified that error appears in the above-indentified patent and that said Letters Patent is hereby corrected as shown below:

COLUMN 2:

Line 29, "NM" should read --NH--.

COLUMN 3:

Line 9, "rad" should read --read--.

COLUMN 4:

Line 37, "remain" should read --remains--.

COLUMN 6:

Line 52, "De" should read --be--.

COLUMN 8:

Line 38, "bV" should read --by--.
Line 41, "to degraded" should read --to be degraded--.

COLUMN 9:

Line 31, "3in" should read --In--.

UNITED STATES PATENT AND TRADEMARK OFFICE

CERTIFICATE OF CORRECTION

PATENT NO. :5,363,182

DATED :November 8, 1994

INVENTOR(S) :IKUO KURIBAYASHI, ET AL.

It is certified that error appears in the above-indentified patent and that said Letters Patent is hereby corrected as shown below:

COLUMN 12:

Line 3, "claim" should read --claim 9,--;
Line 7, "claim" should read --claim 9,--; and
Line 10, "adjacent" should read --adjacent to--.

Signed and Sealed this

Ninth Day of May, 1995

Bruce Lehman

*Attest:*

BRUCE LEHMAN

*Attesting Officer*

*Commissioner of Patents and Trademarks*